United States Patent [19]

Farnell, Jr.

[11] Patent Number: 5,054,356

[45] Date of Patent: Oct. 8, 1991

[54] GUITAR

[76] Inventor: Alfred D. Farnell, Jr., 10700 Jersey Blvd., #670, Rancho Cucamonga, Calif. 91730

[21] Appl. No.: 581,883

[22] Filed: Sep. 13, 1990

[51] Int. Cl.[5] ..... G10D 3/00

[52] U.S. Cl. ..... 84/291

[58] Field of Search ..... 84/267, 291, 293, 298, 84/292

[56] References Cited

U.S. PATENT DOCUMENTS 3,427,915 2/1969 Mooney ..... 84/275

4,185,534 1/1980 Cove ..... 84/291

4,290,336 9/1981 Peavey ..... 84/291

4,313,362 2/1982 Lieber ..... 84/267

4,450,748 5/1984 Shaw et al. ..... 84/291

*Primary Examiner*—Brian W. Brown

*Attorney, Agent, or Firm*—Boniard I. Brown

[57] ABSTRACT

A guitar has a hollow plastic body including spaced front and back panels, and a foam plastic core disposed between the panels, whereby upon vibration of the panels air trapped within the individual cells of the foam core are alternately pressurized and depressurized, thus to enhance the musical output of the guitar.

9 Claims, 2 Drawing Sheets

FIG—.1
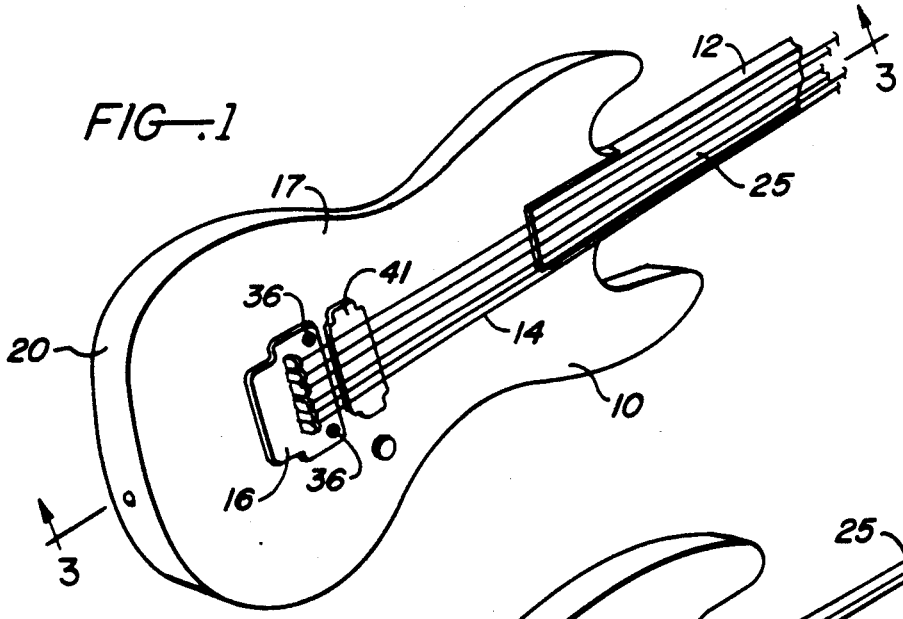
FIG—.2
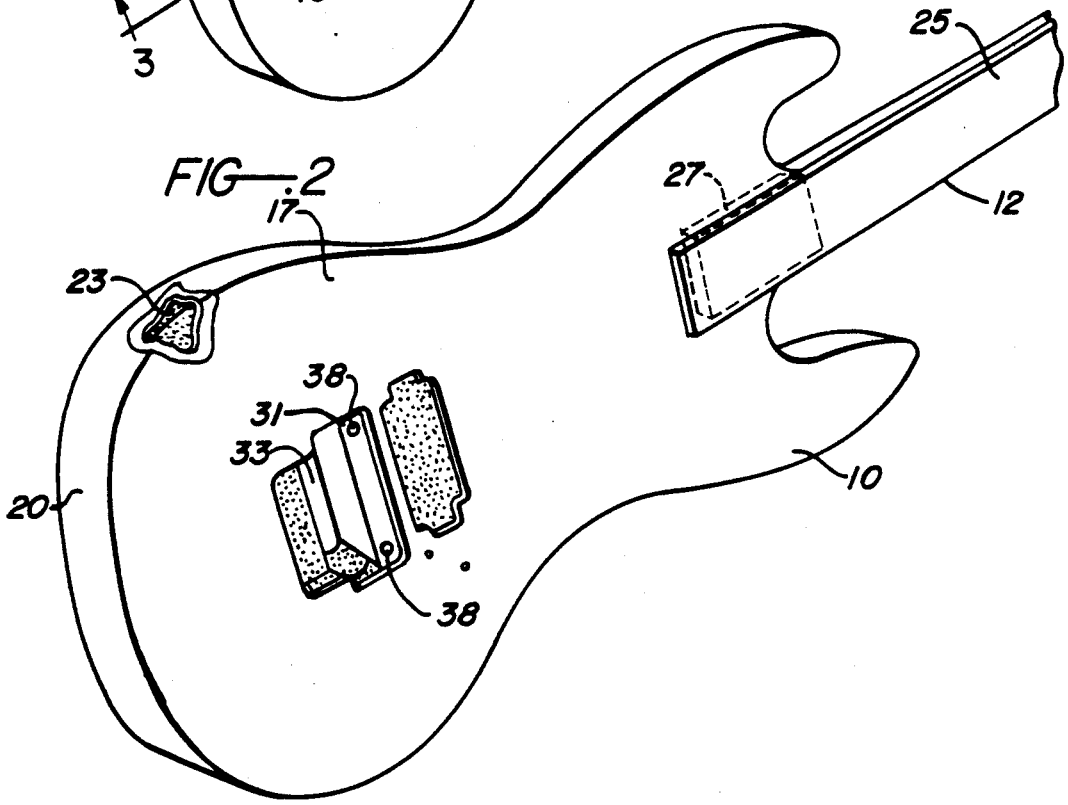
FIG—.3
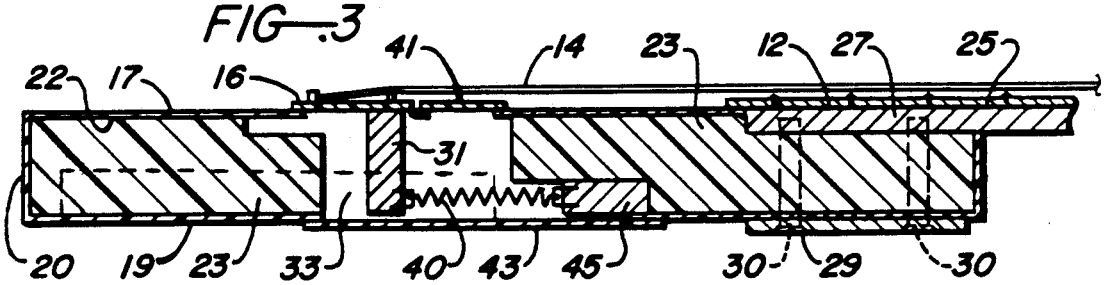

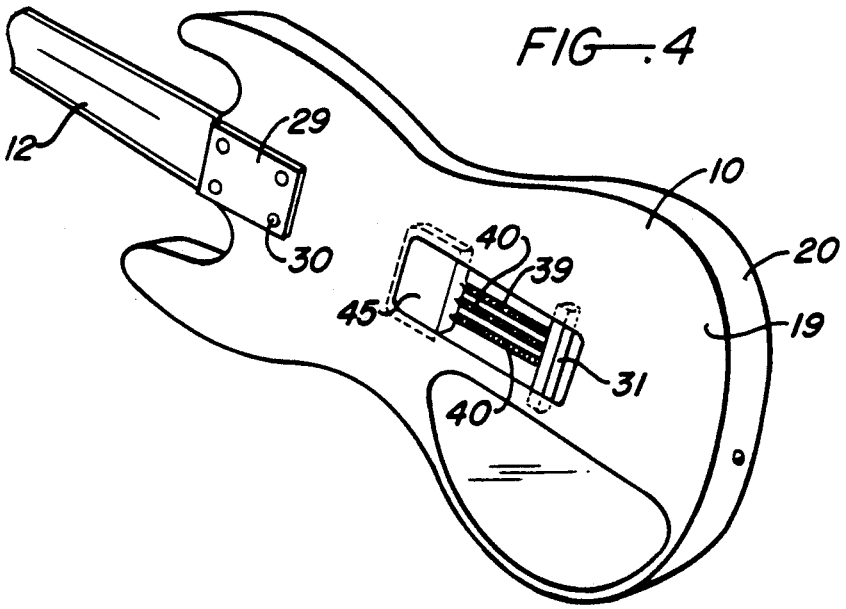
FIG—.4
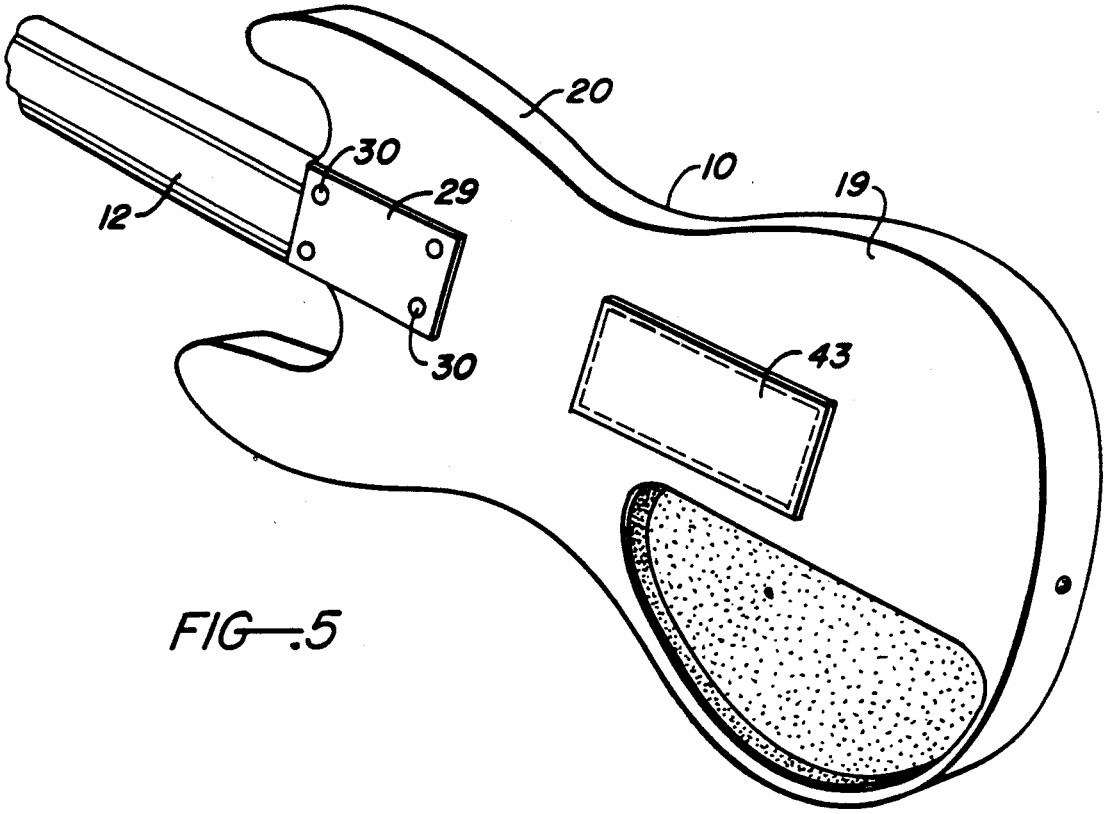
FIG—.5

GUITAR

BACKGROUND AND SUMMARY OF THE INVENTION

The present invention relates to musical instruments, and more particularly to guitars.

Conventional guitar comprise hollow wooden bodies having front and back panels spaced apart by a perimeter side wall. Guitar strings extend from a bridge attached at a central point on the front panel to a head mechanism on a neck structure extending longitudinally away from the guitar body. A fretboard is attached to a longitudinal face of the neck structure.

The guitar is played by pressing the fingers of one hand against tensioned strings at different selected points (wires) along the fretboard, while strumming the fingers of the other hand over the strings at points near the bridge. Apparently, vibrational motions of the strings are transmitted through the bridge to the front panel, thereby raising and lowering the front panel of the guitar body in a vibratory fashion. Air within the guitar is alternately pressurized and depressurized to generate musical sounds. The front panel of the guitar body acts as a vibratory sound board. A circular opening extends through the front panel to facilitate sound transmission from within the guitar outwardly to the ambient atmosphere. Most of the emitted sound passes through the circular opening in the front panel.

The guitar of the present invention comprises an imperforate hollow body at least partially filled with a foam core. A front panel of the hollow body supports a conventional bridge and a longitudinally extending fretboard. The guitar strings extend from the bridge over and along the fretboard to a conventional head mechanism in generally conventional manner.

The present invention is concerned primarily with the rigid foam core located within the guitar body. It has been found that when the foam core is used, more resonant sounds are produced. Apparently, tiny cell walls of the foam core vibrate to enhance the musical sound. The foam core has the same thickness as the spacing between the front and back panels of the guitar body. Therefore, the major faces of the foam core are in contact with inner surfaces of the panels. However, a central transverse passage extends through the foam core and appears to improve the musical output. Also, recesses are defined in opposite faces of the foam core body to further improve the musical effects. The guitar produces a more resonant audible output than a conventional guitar.

BRIEF DESCRIPTION OF THE DRAWINGS

FIG. 1 is a front perspective view of a guitar according to the invention;

FIG. 2 is a perspective view in the direction of FIG. 1, with parts removed to show interior features;

FIG. 3 is a longitudinal sectional view taken at line 3—3 in FIG. 1.

FIG. 4 is a rear perspective view of the guitar of FIG. 1; and

FIG. 5 is a perspective view in the direction of FIG. 4, with parts removed to show interior features.

DESCRIPTION OF A PREFERRED EMBODIMENT OF THE INVENTION

Referring to the drawings, a guitar according to the invention is shown as comprising a hollow guitar body 10, an elongated neck structure 12, and a plurality of tensioned strings 14. Each string has one end thereof suitably anchored to a bridge 16 located on one face of body 10, and has its other end connected to a conventional tensioning (adjusting) mechanism carried by a head structure at the non-illustrated end of neck structure 12. The tensioning mechanisms may typically individually include a rotary post having a worm wheel in mesh with a manually rotatable worm gear (not shown).

Guitar body 10 comprises a front panel 17, a back panel 19, and an edge wall 20 extending along and between edge areas of the two panels. Edge wall 20 circumscribes a hollow space 22 between the two panels. Wall 20 and the two panels 17 and 19 are preferably formed of relatively thin plastic sheet material having a wall thickness of about 0.1 inch. One suitable plastic is polyvinyl chloride in sheet form.

Disposed within the hollow guitar body is a unitary foam core 23 which conforms to the shape of the hollow space 22, except that portions of the core are cut away to define cavities. Core 23 is preferably formed of closed cell foamed rigid plastic, e.g., polyethylene, having a density of about six pounds per cubic foot. A closed cell foam material is preferred over an open celled material. The foam core is preferably formed to desired configuration separately from the plastic shell defined by panels 17, 19 and edge wall 20.

In one contemplated manufacturing method, the individual panels 17 and 19 are cut to the shape of the foam core, with the panel edges extending beyond the side surface walls of the foam core, e.g., by about one eighth inch. Edge wall 20 is then heated with a heat gun go that it becomes pliable enough to bend to conform to the edge curvature of panels 17 and 19. With the foam core adhesively attached to both panels and edge wall 20 in place along edge areas of the panels, a heat gun may be used to heat the joints between wall 20 and the two panels to soften and mold the wall areas to a slightly rounded corner configuration.

Foam core 23 has a transverse thickness essentially the same as the spacing between panels 17 and 19. Therefore, the major faces of the foam core are in close proximity to the inner surfaces of these panels. The major faces of foam core 23 are adhesively attached to panels 17 and 19.

A generally conventional neck structure 12 and fretboard 25 are attached to the guitar body 10. Neck structure 12 includes a tenon 27 fitted into mating slots in panel 17 and the front face of foam core 23. Tenon 27 has a transverse width dimension that is less than the width dimension of fretboard 25, so that the fretboard lies flat against the outer face of panel 17. A reinforcement plate 29 lies flat against panel 19. Four screws 30 extend through plate 29 into threaded openings in tenon 27 for securing neck structure 12 to guitar body 10.

Bridge 16 may be attached to panel 17 by means of two screws 36 extended through the bridge into a reinforcement bridge support bar 31 located within a cavity 33 in foam core 23. Holes for the bridge attachment screws are shown at 38 in FIG. 2. Bar 31 is affixed to panel 19 and, as seen in FIG. 4, extends laterally beyond an elongated opening in panel 19 so that end areas of the bar can be secured to the panel.

Cavity 33 in core 23 is closed by cover elements 41, 43 which extend across openings in panels 17 and 19. Thus, neither panel has a hole therethrough similar to the circular sound hole commonly found in conventional guitars. Air is trapped within space 22 of the guitar body to reverberate within the cells of foam core 23. In the illustrated guitar, a major portion of the sound generated within the guitar body is transmitted to the atmosphere through panel 19 and a sound pick up device 39 attached between bar 31 and a block 45. The pick up device comprises three coil springs 40 extending between bar 31 and blocks 45. The bar and block are secured to panel 19. Preferably, the bar and block are formed of wood. The threaded holes 38 (FIG. 2) may be formed by metal inserts in wooden bar 31.

Guitars having foam cores 23 therein have been found to have a resonant quality wherein each note will reverberate for a lengthened period of time, up to about eight seconds without electrical amplification. It is believed that foam core 23 is responsible for the increased resonance. Cavity 33 transmits pressure pulses into the foam core. The cell walls within foam core 23 are believed to act as miniature diaphragms which generate tiny audible pulses in response to vibratory motion of panels 17 and 19. Air pressure waves are generated from one closed cell to the next closed cell, through the cell walls and the air contained within the individual cells. The cummulative effect is to produce a resonant audible output through pick up device 39. Air trapped in cavity 33 becomes alternately pressurized and depressurized in response to vibratory movements of panel 17 and 19. Air pressure forces grnerated by the trapped body of air tend to enhance the vibratory action of the foam core cell walls.

Thus there has been shown and described a novel guitar which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A guitar comprising:

a hollow guitar body including a front panel, a back panel, and an edge strip extending right angularly between edge areas of the two panels to circumscribe a hollow space within the guitar body, a flat fretboard attached flatwise to said front panel and extending longitudinally beyond the guitar body, said front panel having a central opening therein, a bridge support bar extending from the rear panel through the central opening in the front panel, a bridge positioned on the front panel in spanning relation to the central opening, means attaching the bridge to the support bar, a plurality of tensioned strings anchored to the bridge and extending along the front panel and fretboard, and a foam core within said guitar body hollow space.

2. A guitar according to claim 1, wherein: said foam core is formed of a rigid plastic foam material.

3. A guitar according to claim 1, wherein: said foam core is formed of a rigid plastic foam material having closed cells.

4. A guitar according to claim 1, wherein:

said foam core has a central transverse cavity therethrough in communication with said bridge, said bridge support bar being located within said cavity.

5. A guitar according to claim 1, wherein:

the foam core has a first face adhesively secured to said front panel, and a second face adhesively secured to the back panel.

6. A guitar according to claim 5, wherein:

said foam core has a central transverse cavity therethrough in communication with said bridge, said bridge support bar extending within said cavity for supporting said bridge on the front panel, said bar being in facial engagement with the back panel, and said bridge being in facial engagement with said bar.

7. A guitar according to claim 1, wherein:

said front and back panels are essentially flat panels formed of a plastic sheet material having a thickness of about 0.1 inch.

8. A guitar according to claim 1, wherein:

said front and back panels are substantially flat panels spaced apart about one and one-half inch, and said core has the same thickness as the panel spacing whereby the major faces of the foam core are in contact with inner surfaces of the front and back panels.

9. A guitar according to claim 1, wherein: the front and back panels are imperforate panels devoid of sound openings.

* * * * *